US006135404A

United States Patent [19]

Wisniewski et al.

[11] Patent Number: 6,135,404

[45] Date of Patent: Oct. 24, 2000

[54] KEYBOARD MOUNTING MECHANISM

[75] Inventors: Michael G. Wisniewski, North East, Pa.; Carl H. Little, Jamestown; R. Craig Kauffman, East Aurora, both of N.Y.

[73] Assignee: Weber Knapp Company, Jamestown, N.Y.

[21] Appl. No.: 09/186,719

[22] Filed: Nov. 5, 1998

[51] Int. Cl.[7] ..... A47F 5/00

[52] U.S. Cl. ..... 248/281.11; 248/284.1; 248/918

[58] Field of Search ..... 248/281.11, 284.1, 248/286.1, 279.1, 918, 118, 118.1, 118.3; 108/6, 7, 9

[56] References Cited

U.S. PATENT DOCUMENTS

| | | | |
|---|---|---|---|
| 142,263 | 8/1873 | Morrison | 248/281.11 |
| 169,382 | 11/1875 | Starr | 248/281.11 |
| 213,775 | 4/1879 | Redman et al. | 248/281.11 |
| 274,223 | 3/1883 | Redman | 248/281.11 |
| 714,694 | 12/1902 | Holtz | 248/281.11 |
| 967,877 | 8/1910 | Bauer | 248/447.2 |
| 1,050,672 | 1/1913 | MacIntosh | 248/281.1 |
| 1,139,581 | 5/1915 | Riley | 248/281.11 |
| 1,176,272 | 3/1916 | Bultman | 248/281.11 |
| 3,436,046 | 4/1969 | Valeska | 248/284.1 |
| 4,691,888 | 9/1987 | Cotterill | 248/248.1 |
| 5,292,097 | 3/1994 | Russell | 248/281.11 |
| 5,924,664 | 7/1999 | Mileos et al. | 248/281.11 |

*Primary Examiner*—Anita M. King
*Attorney, Agent, or Firm*—Simpson, Simpson & Synder, L.L.P.

[57] ABSTRACT

A keyboard supporting mechanism employs a parallelogram linkage secured to a mounting member by a single pivot connection for supporting the whole of the linkage and a keyboard support for vertical swinging movement relative to a base, and a locking mechanism for retaining the keyboard support in a desired vertical position, which includes cooperating locking surfaces carried by the linkage and mounting member.

28 Claims, 6 Drawing Sheets

KEYBOARD MOUNTING MECHANISM

BACKGROUND OF THE INVENTION

It is well known to provide a four bar linkage, such as a parallelogram linkage, to mount a support for a keyboard or other desired art device for vertical swinging movement relative to a base, such as a desk or table top, wherein the application of a manual lifting force to the support serves to release the support for vertical swinging movement into a desired position, and the release of such force serves to lock the support in such position. Prior U.S. Patents specifically or inherently disclosing this general type of mounting mechanism including U.S. Pat. Nos. 169,382; 213,775; 274,223; 714,694; 967,877; 1,050,672; 1,139,581; 1,176,272; 3,436,046; and 5,292,097.

Further, above U.S. Pat. Nos. 274,223; 714,694; 3,436,046 and 5,292,097, disclose the use of frictional engagement on cooperating locking surfaces carried by a four bar linkage to releasably lock a support in a selected position; and above U.S. Pat. Nos. 169,382; 213,775; 967,877; 1,050,672; 1,139,581; 1,176,272; and 5,292,097 disclose use of engagement between serrations on cooperating locking surfaces carried by a four bar linkage for a like purpose.

SUMMARY OF THE INVENTION

The present invention is particularly directed to a mechanism for mounting a keyboard support for vertical swinging movement relative to a base, and more particularly to a keyboard mounting mechanism having a locking mechanism, which normally serves to releasably retain the support in a desired vertical position and is released upon the application of a lifting force to such support.

In its broadest aspect, the present invention differs from the known prior art, as illustrated by the above cited prior patents, in that its four bar linkage is secured to a mounting member by a single pivot connection, whereby to permit the whole of the four bar linkage to swing vertically with a keyboard support relative to a base mounting member, and in that the cooperating locking surfaces, which serve to releasably retain the keyboard support in a desired position are carried by one link of the four bar linkage and the mounting member.

BRIEF DESCRIPTION OF THE DRAWINGS

The nature and mode of operation of the present invention will now be more fully described in the following detailed description taken with the accompanying drawings wherein.

DETAILED DESCRIPTION

Figures 1, 3:
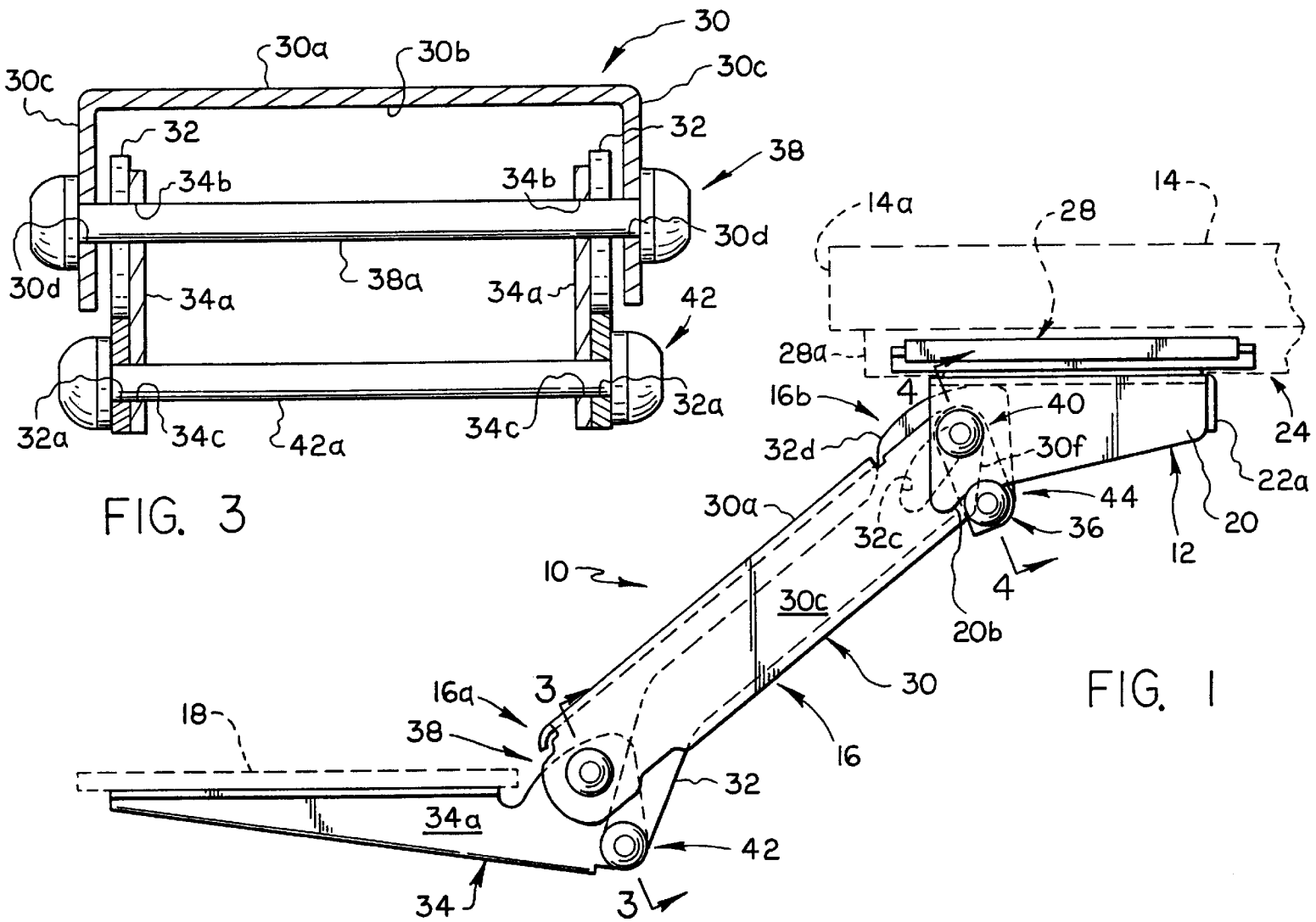
FIG. 1 is a side elevational view of a keyboard support mechanism formed in accordance with the present invention, showing a keyboard support in a lowermost position.
FIG. 3 is a sectional view taken generally along the line 3—3 in FIG. 1.
Figure 2:
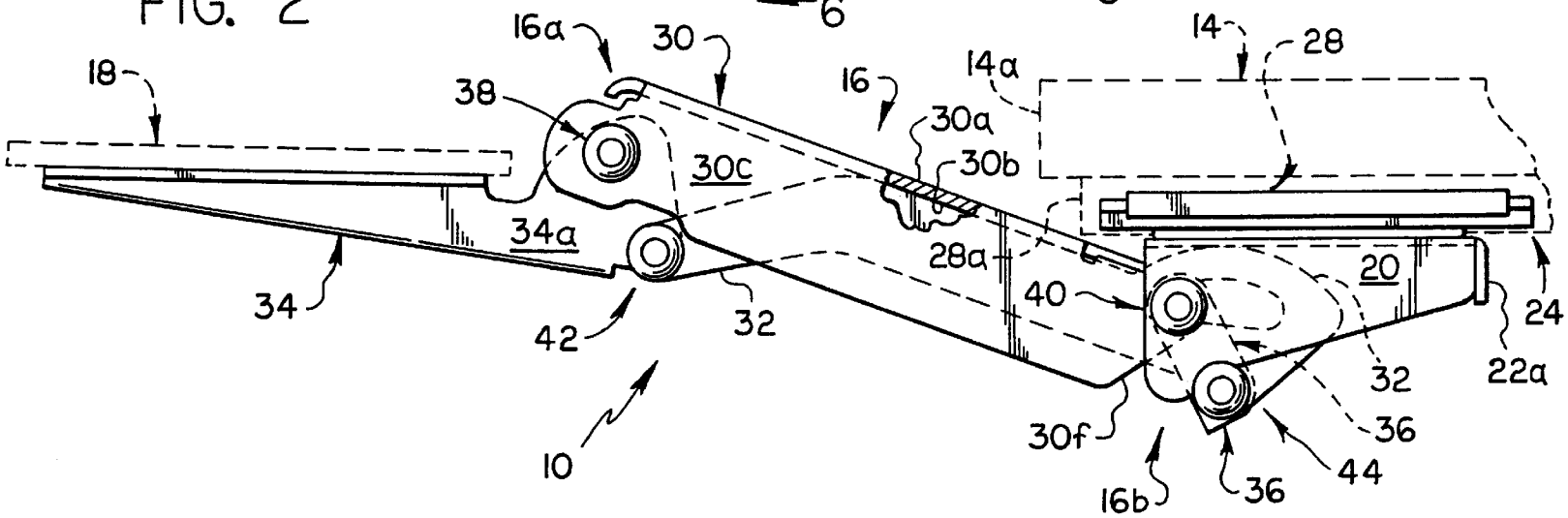
FIG. 2 is a view similar to FIG. 1, but showing the keyboard support in an uppermost position.

Reference is first made to FIGS. 1 and 2, wherein a keyboard mounting mechanism of the present invention is generally designated as 10 and shown as including a mounting member 12 adapted to be fixed to a base, such as a table or desk top or other work surface shown in broken line as 14; and a four bar linkage 16 having a first end 16*a* for mounting a keyboard support shown in broken line at 18 and a second end 16*b* pivotally connected to mounting member 12 for permitting vertical swinging movement of the four bar linkage and keyboard support relative to the mounting member between lowermost and uppermost use positions shown in FIGS. 1 and 2, respectively.

Mounting member 12 is shown as being in the form of an inverted U-shaped bracket having side walls 20,20 and a connecting top wall 22. As is conventional, top wall 22 may be suspended below base 14 by an intermediate bracket 24 for pivotal movement about a vertically disposed axis or for both pivotal movement and sliding movement normal to the base front edge 14*a* by a base affixed guide track, which is generally designated at 28 and enclosed at its front end with a track guard 28*a*. Alternatively, top wall 22 may be non-movably fixed directly to the lower surface of base 14.

Figure 4:
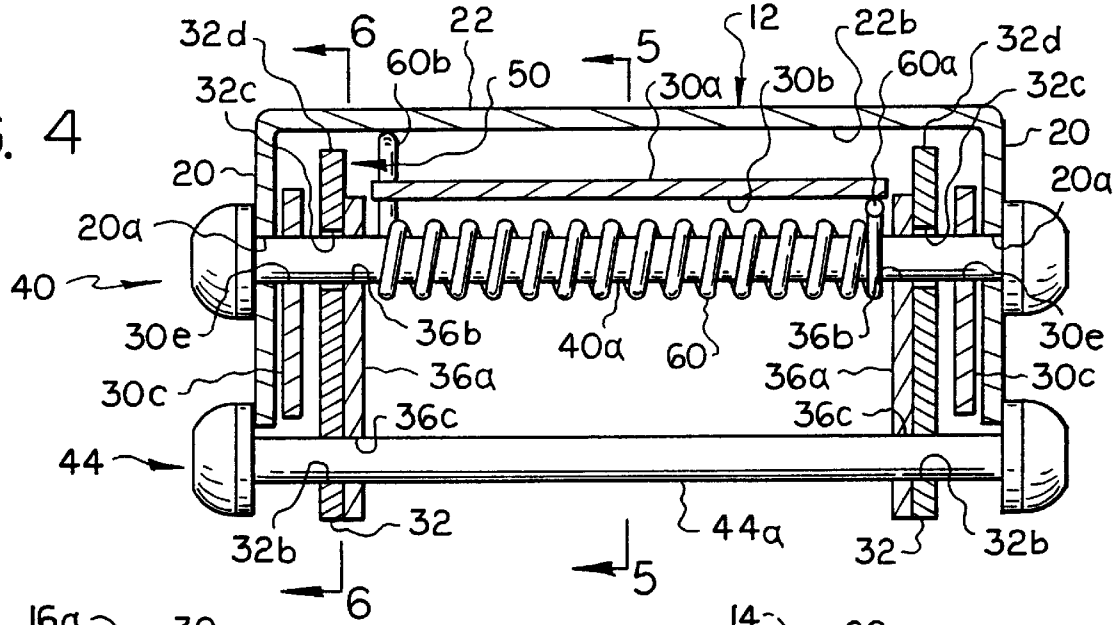
FIG. 4 is a sectional view taken generally along the line 4—4 in FIG. 1.
Figures 5, 6:
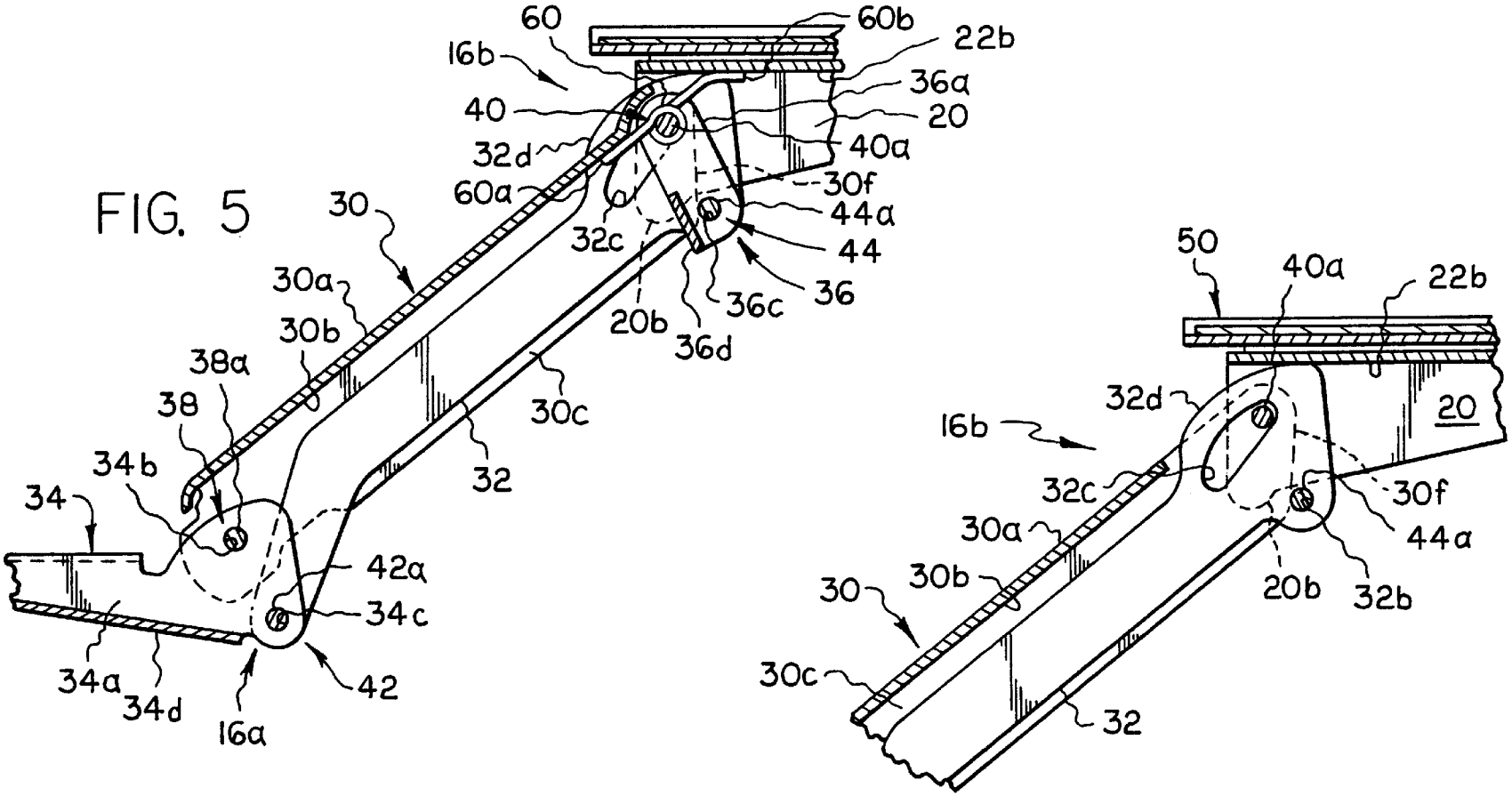
FIG. 5 is a sectional view taken centrally and lengthwise the mechanism generally along the line 5—5 in FIG. 4.
FIG. 6 is a sectional view taken generally along the line 6—6 in FIG. 4.

Bracket side walls 20,20 are best shown in FIG. 4 as being formed with aligned bore openings 20*a*,20*a*, and in FIGS. 1 and 6 as being formed with aligned abutment surfaces 20*b*,20*b*. Bracket top wall 22 is shown in FIGS. 1, 2, 5 and 6 as having a depending rear flange 22*a* and a downwardly facing planar surface 22*b*.

Four bar linkage 16 is shown as including an inverted U-shaped upper or first link 30; a pair of lower or second links 32,32; a first end or third link 34 adapted to be suitably fixed to keyboard support 18; a U-shaped second end or fourth link 36; and first, second, third and fourth pivot connections 38, 40, 42 and 44, respectively, serving to pivotally interconnect the links for relative pivotal or swinging movement about parallel axes. As will be apparent, a pair of links may replace upper link 30, and a single link may replace the pair of lower links 32,32.

Upper link 30 has a connecting flange 30*a* defining a lower abutment surface 30*b*; and a pair of parallel side wall flanges 30*c*,30*c*, which are formed adjacent linkage first end 16*a* with a pair of aligned bore openings 30*d*,30*d* and adjacent linkage second end with a pair of aligned bore openings 30*e*,30*e* and a pair of rear edges or abutment surfaces 30*f*,30*f*. Lower links 32,32 are formed adjacent linkage first end 16*a* with a pair of aligned bore openings 32*a*,32*a*; and adjacent linkage second end 16*b* with a pair of aligned bore openings 32*b*,32*b*, enlarged clearance openings 32*c*,32*c*, and curved edge surfaces 32*d*,32*d*, which in a presently preferred construction, lie essentially equidistant from the centers or axis of bore openings 32*b*,32*b*.

First end link 34 is shown in FIGS. 1, 2, 3 and 5 as having a pair of generally L-shaped side wall flanges 34*a*,34*a* formed with a pair of upper, aligned bore openings 34*b*,34*b* and a pair of lower, aligned bore openings 34*c*,34*c*; and a connecting flange 34*d*. Side wall flanges 34*a*,34*a* are provided with mounting openings, not shown, for attachment of support 18.

Second end link 36 is best shown in FIGS. 4 and 5 as having a pair of side wall flanges, 36*a*,36*a* formed with a pair of upper aligned bore openings 36*b*,36*b* and a pair of lower aligned bore openings 36*c*,36*c*; and a transversely extending connecting flange 36*d*.

First pivot connection 38 is defined by fitting a first pivot pin 38*a* within bore openings 30*d*,30*d* and 34*b*,34*b*. Second pivot connection 40 is defined by fitting a second pivot pin 40*a* within bore openings 30*e*,30*e* and 36*b*,36*b*. Third pivot connection 42 is defined by fitting a third pivot pin 42*a* within bore openings 32*a*,32*a* and 34*c*,34*c*. Fourth pivot connection 44 is defined by fitting a fourth pivot pin 44*a* within bore openings 32*b*,32*b* and 36*c*,36*c*. Second pivot connection 40 preferably serves to additionally pivotally mount linkage 16 on mounting member 12 by positioning the opposite ends of pivot pin 40*a* within bore openings 20*a*,20*a*.

While one or more of pivot pins 38*a*, 40*a*, 42*a* and 44*a* may be replaced by pairs of short, axially aligned stub pivot shafts, it is preferable to employ the illustrated elongated, pivot pin arrangement in view of strength considerations. However, when elongated pivot pin 40*a* is employed, it is preferable to provide lower links 32,32 with clearange openings 32*c*,32*c* for freely receiving the pivot pin, and such openings should be arranged and shaped to avoid any contact between the pivot pin and the lower links, which would otherwise interfere with the preferred mode of operation of mechanism 10 to be described.

Linkage 16 is preferably in the form of a parallelogram, although it will be understood that linkages departing from a true parallelogram may be employed.

Mechanism 10 additionally includes a locking mechanism or device 50 adapted to releasably lock or retain linkage 16 and keyboard support 18 in any desired vertical use position including their lower and upper positions shown in FIGS. 1 and 2. In accordance with the preferred form of the invention, locking device 50 is defined by releasably frictional engagement of a first locking surface defined by curved surfaces 32*d*,32*d* of lower links 32,32, and a second locking surface defined by mounting bracket lower surface 22*b*.

Further, mechanism 10 preferably includes a coil spring 60, which is disposed about pivot pin 40*a* with its opposite ends 60*a* and 60*b* arranged to bear on upper link lower abutment surface 30*b* and mounting bracket flange lower surface 22*b*, respectively. Spring 60 may be designed to counterbalance some desired portion of the weight of linkage 16 and keyboard support 18 in order to facilitate adjustment of the mechanism by a user.

It will be understood that the illustrated construction of linkage 16 allows free movement of its links between a relatively collapsed or converged condition, which is shown in FIG. 2 as being defined by engagement of lower links 32,32 with lower surface 30*b* of upper link 30, and a relatively extended or diverged condition shown in FIGS. 1 and 6 as being defined by engagement of rear edges 30*f*,30*f* of the upper link with fourth pivot pin 44*a*. It will also be understood that the single pivotal connection of linkage 16 to mounting member 12 provided by pivot pin 40*a* allows the linkage to be swung vertically relative to such mounting member to provide a range of positions in which support 18 may be placed by an operator, as required adjust the height at which a keyboard is presented for use by such operator. The upper extent of such range of swinging movement may be variously defined, but in the presently preferred construction is limited by engagement of upper link 30 with track guard 28*a*. For installations where intermediate bracket 24 and track 28 are eliminated, and mounting member 24 fixed directly to the lower surface of base 14, the extent of upward swinging movement of linkage 16 may be defined by engagement of upper link 30 with the front edge of the mounting member.

The actual uppermost use position of linkage 16 shown in FIG. 2 is slightly below the upper extent of the permissive range of its swinging movement, since a slight lowering of the linkage occurs incident to the locking mechanism becoming effective in the manner to be described. The lowermost use position of linkage 16 shown in FIG. 1 occurs when the linkage reaches its extended condition and the force of gravity acting on fourth pivot pin 44*a* incident to engagement thereof by upper link rear edges 30*f*,30*f* causes the fourth pivot pin to swing counterclockwise about second pivot pin 40*a*, as viewed in FIG. 6, and thus drive lower link surfaces 32*d*,32*d* upwardly into firm frictional, locking engagement with lower surface 22*b* of mounting member 12.

Still further, it will be understood that for a given set of distances between the axis of second pivot pin 40*a* and surface 22*b*, and between the axes second pivot pin and fourth pivot pin 44*a*, a radius, as measured between the axis of fourth pivot pin and lower link surfaces 32*d*,32*d* and determined on trial and error basis, may be selected in order to cause the upper or keyboard supporting surface of support 18 to reside in an essential horizontal attitude in its selected use positions throughout the range of the vertical swinging movement of linkage 16. Alternatively, if a smaller radius is chosen, support 18 will be caused to assume a positive tilt, i.e. tilt towards an operator, in each of its use positions. Conversely, if a larger radius is chosen, support will be caused to assume a negative tilt, i.e. tilt away from an operator, in each of its use positions.

To facilitate description of the operation of mechanism 10, as thus far described, it will be assumed that keyboard support 18 resides in its above described lowermost use position shown in FIG. 1. In this position, the right hand end of surfaces 32*d*,32*d* engage with surface 22*b* and the upper surface of support 18 lies essentially horizontal. Two possible modes of operation are presented for purposes of moving support 18 upwardly into a selected use position, namely, an operator may grip and lift the support while maintaining same in its original horizontal orientation, or an operator may simply lift the support while permitting the support to assume a negative tilt, as an incident to which locking surfaces 32*d*,32*d* are swung away from locking engagement with locking surface 22*b* in a direction extending clockwise of pivot pin 44*a*, as viewed in FIG. 6. The extent of negative tilt may be limited for instance by engagement of the ends of fourth pivot pin 44*a* with abutment surfaces 20*b*,20*b*.

In the first mode of operation, the locking surfaces slide across one another and the force of gravity is effective to automatically lock support 18 in any elevated use position whenever the lifting force is removed.

In the second mode of operation, it is necessary for an operator to tilt support 18 forwardly about the axis of first pivot pin 38*a* to again assume its initial horizontal attitude, when a desired use position has been reached and before releasing the lifting force, since lower link locking surfaces are not returned for locking engagement with locking surface 22*b* until the support is returned to its initial horizontal attitude. In either mode of operation, the portions of locking surfaces 32*d*,32*d* presented for contact with surface 22*b* for locking purposes progressively moves to the left, or counterclockwise, as viewed in FIGS. 1, 5 and 6, until the uppermost use position is reached.

When it is desired to move support 18 downwardly into a lower use position, an operator is required to grip the support and then tilt same rearwardly or in the direction of negative tilt sufficiently to remove lower link surfaces 32*d*,32*d* from locking engagement with surface 22*b*, lower the support to a desired use position, and then tilt the support forwardly to again assume its horizontal attitude in order to effect reengagement of locking surfaces 32*d*,32*d* with locking surface 22*b*.

Figures 7, 8:
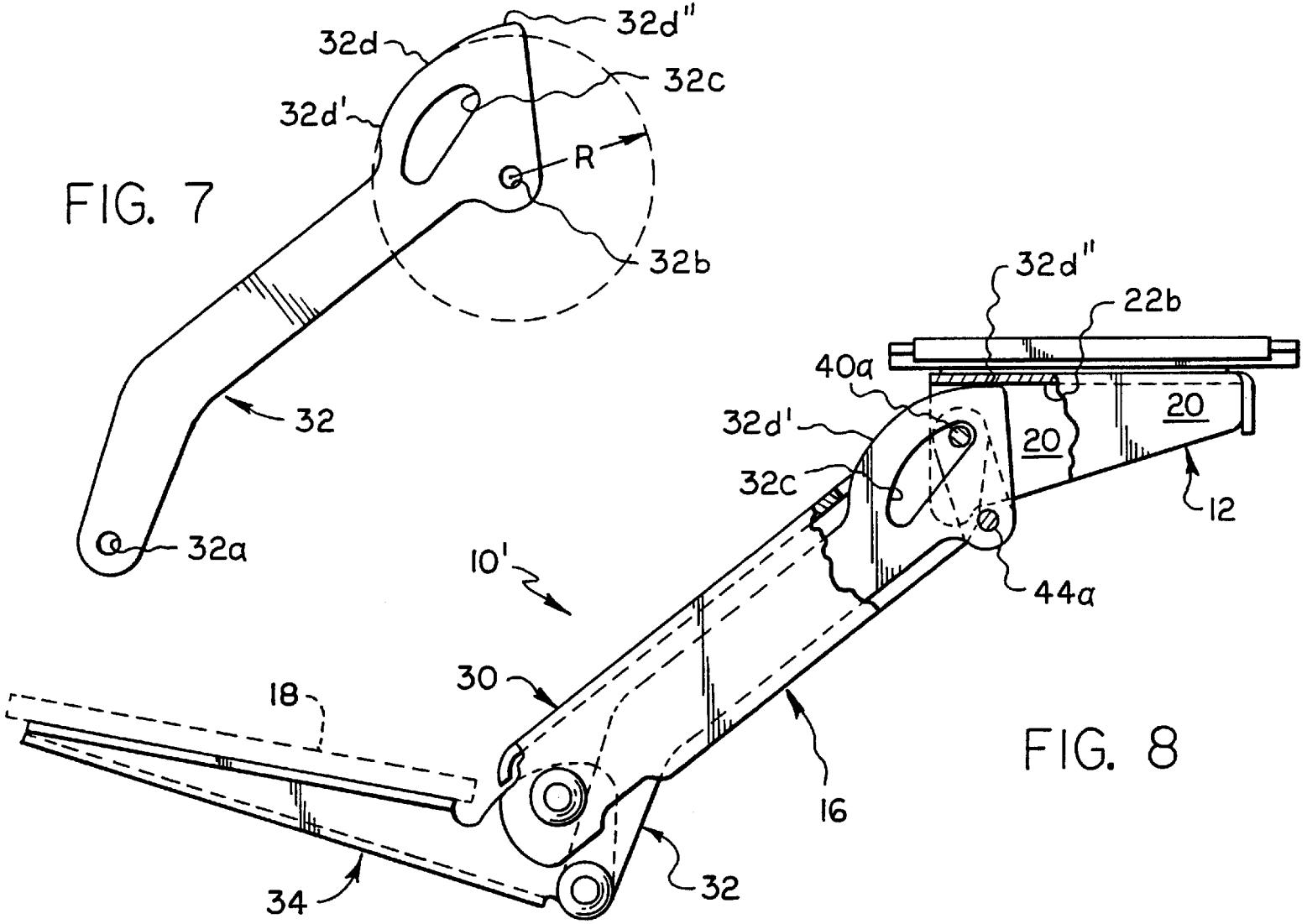
FIG. 7 is a side elevational view of a lower link employed in the mechanism of FIG. 8.
FIG. 8 is a side elevational view of an alternative construction in which the keyboard support is automatically placed in a negative tilt position upon movement thereof into its lowermost position.

An alternative construction designated in FIG. 8 as 10', may be identical to that previously described, except for the shape of locking surfaces of lower links 32,32. Specifically, these locking surfaces are best shown in FIG. 7 as including a first curved portion 32*d*', whose radius of curvature R is selected for example to provide support 18 with a horizontal attitude throughout the upper portion of the range of travel of linkage 16; and a second curved portion 32*d*" whose radius of curvature is greater than R in order to provide the support with a negative tilt throughout the lower portion of such range terminating in the lowermost position shown in FIG. 8. This construction has utility where it is desirable to provide for clearance between the knees of an operator and first end link 34 when support 18 has been placed in its lowermost position and mechanism 10 slid rearwardly into a storage position beneath base 14.

Figure 9:
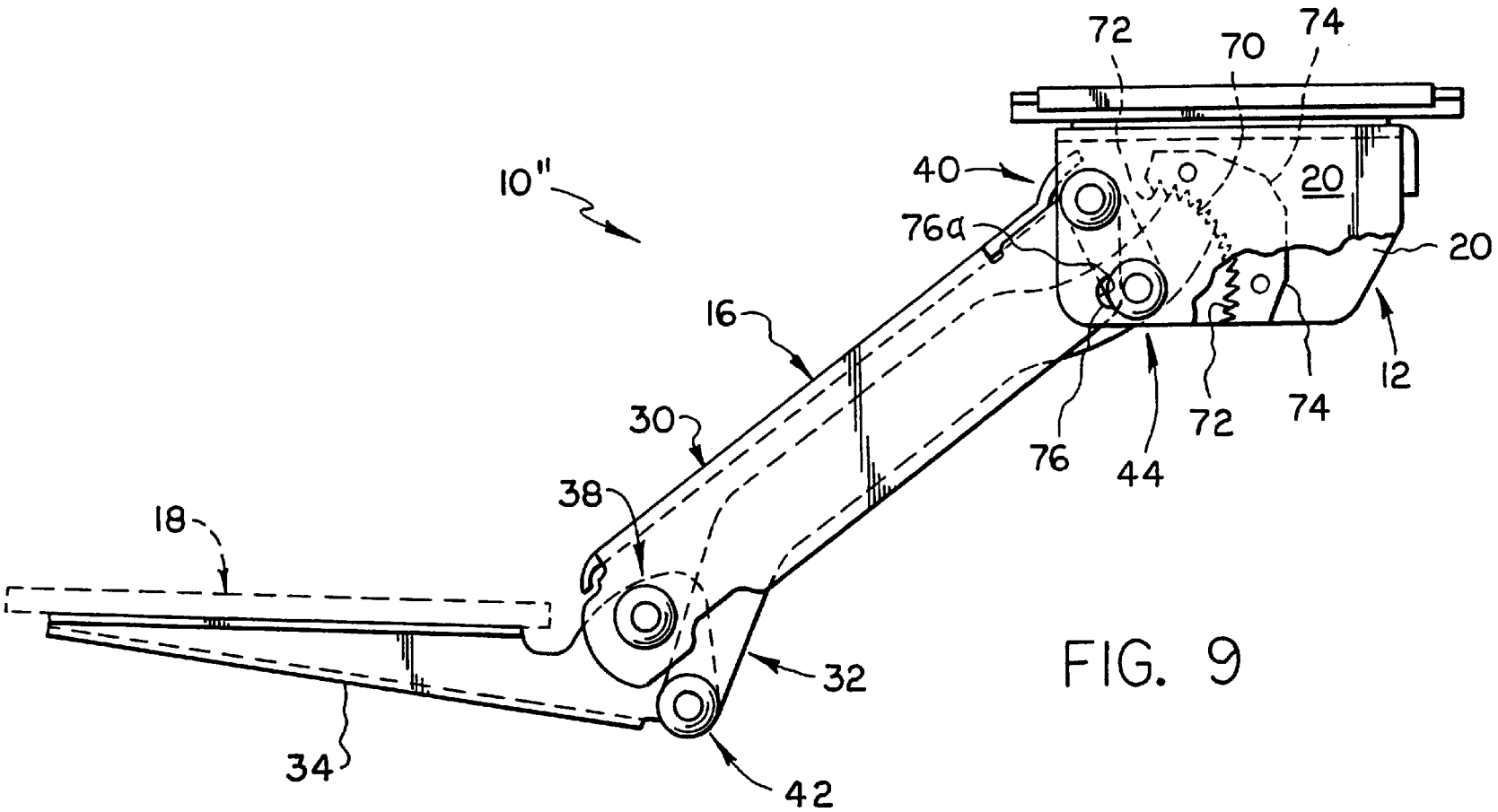
FIG. 9 is a side elevational view of an alternative construction in which the lock mechanism employs serrated surfaces.
Figure 13:
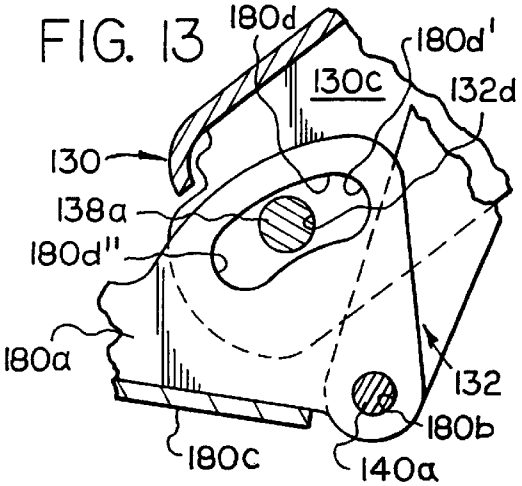
FIG. 13 is a sectional view taken generally along the line 13—13 in FIG. 11.
Figure 10:
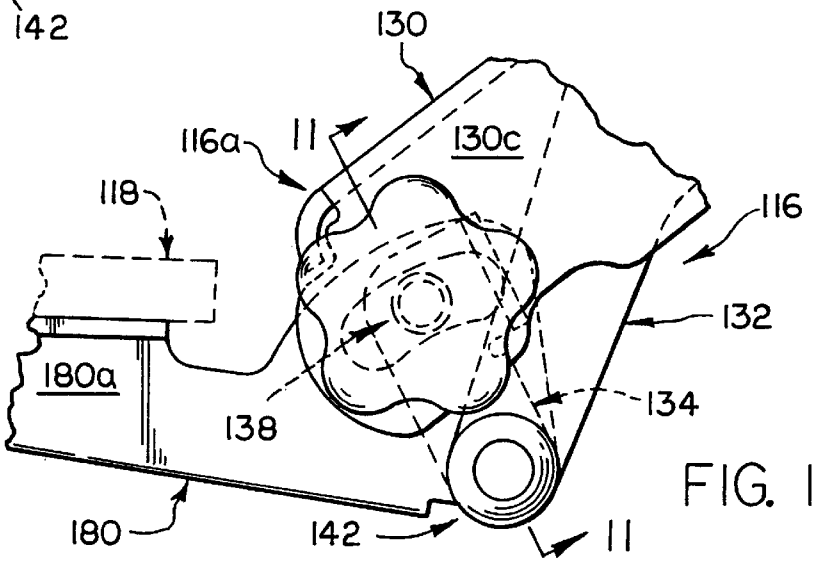
FIG. 10 is a fragmentary, side elevational view showing an alternative construction wherein the keyboard support is supported for positive and negative tilting movements.
Figure 11:
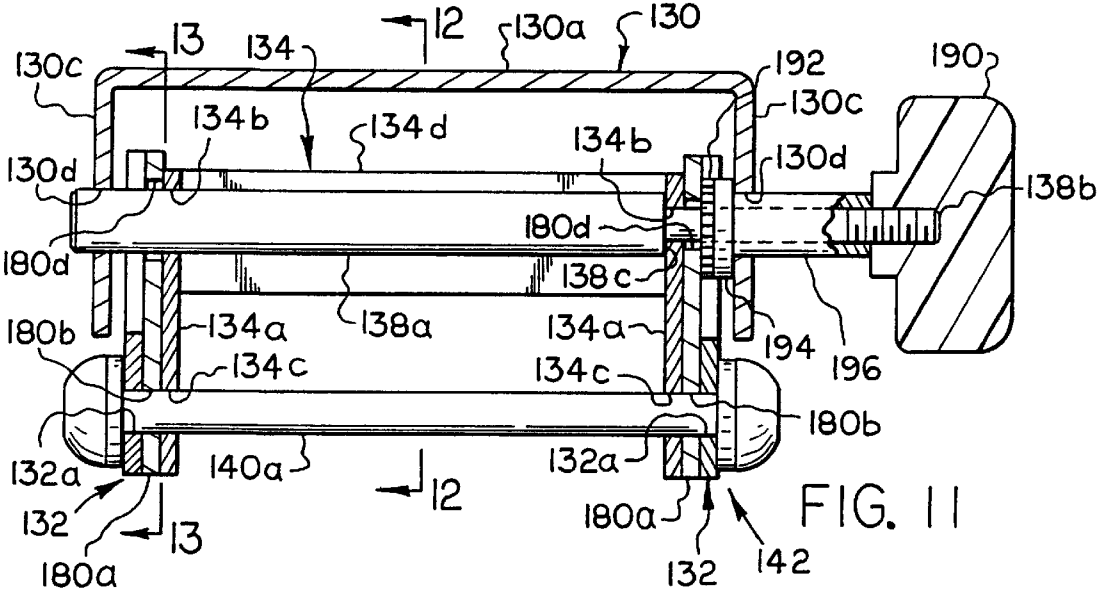
FIG. 11 is a sectional view taken generally along the line 11—11 in FIG. 10.
Figure 12:
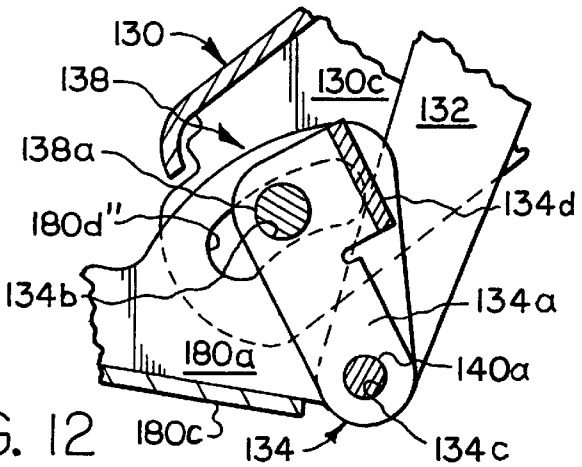
FIG. 12 is a sectional view taken generally along the line 12—12 FIG. 11.

FIG. 9 illustrates an alternative construction of the present mechanism designated as 10", wherein the previously described frictionally engaging locking surfaces are replaced by serrated locking surfaces in the form of a convex, first toothed locking surface 70 formed integrally with the rear end of each lower link 32 and a concave second toothed locking surface 72 defined by a flange 74 suitably affixed to an inner surface of each of the bracket side walls 20,20. Toothed surfaces 70 and 72 preferably lie along arcs having a common center defined by the axis of fourth pivot pin, not shown, forming part of fourth pivot connection 44. If desired, mechanism 10" may be provided with a counterbalance spring, not shown, similar to spring 60. This construction also differs from that previously described in that the arculate length of second toothed surfaces 72, requires bracket side walls 20,20 to be vertically enlarged, thereby requiring each side wall to be provided with a clearance slot 76 sized to freely receive the ends of the fourth pivot pin. The only engagement between the fourth pivot pin and the walls of each slot 76 may occur only when its front end 76*a*, which corresponds in function to above-described abutment surface 20*b*, is engaged by the fourth pivot pin in order to limit the extent of negative tilt of support 18.

Preferably, the first and second toothed surfaces are shaped such as to positively lock against lowering movements of support 18, while permitting the first toothed surfaces to ratchet or slide over the second toothed surfaces when such support is moved upwardly.

In mechanism 10", the several use positions are defined by engagement of first toothed surfaces 70,70 with a different arculately spaced portion of second toothed surfaces 72,72, that is, uppermost end portions of the second toothed surfaces being engaged when support 18 is in its lower use position shown in FIG. 9 and lowermost end portions of the second toothed surfaces being engaged when the support is in its upper use position, not shown.

In operation, an operator may move support 18 upwardly from its lower use position shown in FIG. 9 by one of two methods. In accordance with a first method, an operator would grip and then lift support 18 to a desired upper use position, while allowing first toothed surfaces to ratchet or slide over the second toothed surfaces, and then release the support when a desired upper use position is reached; the toothed locking surfaces automatically engaging under the influence of gravity and becoming effective to prevent lowering movement of the support. In a second method, an operator would grip and apply a negative tilt to support 18 in order to fully withdraw first locking surfaces 70,70 from engagement with second locking surfaces 72,72 and then lift the support into a desired-use position, whereat he would return or permit gravity induced return of the support to its initial horizontally disposed position for purposes of returning the first locking surfaces for locking engagement with the second locking surfaces.

Lowering of support 18 into a lower use position first involves application by an operator of a negative tilt to the support in order to remove first locking surfaces 70,70 from locking engagement with second locking surfaces 72,72; lowering the support to a desired lower position; and finally returning the support to its initial horizontal attitude in order to reengage the locking surfaces.

Reference is now made to FIGS. 10–13 where there is shown a mechanism for selectively and adjustably imparting positive or negative tilt to keyboard support 118 carried adjacent the front end 116*a* of a suitable linkage 116 serving to mount the support for vertical swinging movement relative to a base, not shown. Linkage 116, as shown, is similar to linkage 16 in that it includes an inverted U-shaped upper or first link 130; a pair of lower or second links 132,132; a first end or third link 134; and first and third pivot connections 138 and 142 serving to connect opposite ends of the first end link to the first and second links. The remaining portions of linkage 116 and its mode of attachment to a base may be similar to that shown in FIGS. 1–9, but the tilt control mechanism to be described is not limited thereto.

Upper link 130 has a connecting flange 130*a*; and a pair of parallel side wall flanges 130*c* and 130*c*, which are formed with a pair of aligned bore openings 130*d*,103*d*. Lower links 132,132 are formed with a pair of aligned bore openings 132*a*,132*a*. First end link 134 is of U-shaped configuration including a pair of side wall flanges 134*a*,134*a* having a pair of upper aligned bore openings 134*b*,134*b* and a pair of lower aligned bore openings 134*c*,134*c*; and a connecting flange 134*d*.

First pivot connection 138 is defined by fitting a first pivot pin 138*a* within bore openings 130*d*,130*d* and 134*b*,134*b*. Third pivot connection 142 is defined by fitting a third pivot pin 140*a* within bore openings 132*a*,132*a* and 134*c*,134*c*.

Unlike the initially described construction of the present mechanism, keyboard support 118 is not connected directly to first end link 134, but rather to an intermediate or connecting link 180, which is similar in design to first end link 34 in that it includes a pair of generally L-shaped side wall flanges 180*a*,180*a* adapted to be fixed to support 118 and aligned bore openings 180*b*,180*b* adapted to pivotally receive third pivot pin 140*a*; and a connecting flange 180*c*.

Intermediate link 180 differs from link 34 in that its side wall flanges are formed with arculate slots 180*d*,180*d*, which are sized to slidably receive first pivot pin 138*a* and disposed concentrically of bore openings 180*b*,180*b*. Slots 180*d*,180*d* permit tilting of support 118 between limits of positive tilt and negative tilt defined by engagement of slot abutment ends 180*d*' and 180*d*" with first pivot pin 138*a*.

Intermediate link 180 may be releasably retained at any point along its range of travel or tilting movement about third pivot pin 140*a* by manual operation of a lock control knob 190, which is adjustably threaded onto a reduced diameter, threaded pin end 138*b* of first pivot pin 138*a*. Pin end 138*b* cooperates with the remainder of the first pivot pin to define an annular shoulder 138*c* arranged to engage an inner surface of one of first link side wall flanges 134*a*,134*a* and serves to slidably mount a friction locking washer 192, a bearing washer 194 and a spacer sleeve 196. Threaded rotations of knob 190 relative to pin end 138*b* serves to releasably clamp first end link 134 and intermediate link 180 between shoulder 138*c* and locking washer 192 in order to releasably retain support 118 in a desired tilted position.

While the present invention is particularly adapted for mounting a keyboard, it will be understood that it is equally adapted for supporting any other art device, such as a work surface for use as a writing surface, or for supporting a mouse pad, which is desired to be moved vertically between a number of use positions.

What is claimed is:

1. A mounting mechanism for mounting a support for an art device on a base, comprising a mounting member for attachment to said base; a four bar linkage having a first end for mounting said support and a second end pivotally connected to said mounting member for permitting vertical swinging movement of said support relative to said mounting member between lower and upper positions, said linkage including a relatively upper link, a relatively lower link, a first end link, a second end link, and first, second, third and fourth pivot connections having parallel axes, wherein said upper link has opposite ends pivotally coupled to said first end and second end links by said first and second pivot connections and said lower link has opposite ends pivotally coupled to said first end and second end links by said third and fourth pivot connections, and said second end of said linkage is pivotally connected to said mounting member solely by said second pivot connection; and a locking means for releasably retaining said support in a desired position intermediate said lower and upper positions, said locking means including a first locking surface on said linkage and a second locking surface of said mounting member, said first locking surface being normally gravitationally biased into engagement with said second locking surface for releasably locking said support against downwardly directed vertical swinging movement, and said first locking surface is released from engagement with said second locking surface by applying an upwardly directed manual force to said support.

2. A mechanism according to claim 1, wherein said linkage is a parallelogram linkage.

3. A mechanism according to claim 1, wherein said first and second locking surfaces frictionally engage.

4. A mechanism according to claim 1, wherein said first and second locking surfaces are serrated.

5. A mechanism according to claim 1, wherein an intermediate link is adapted to couple said support to said linkage for adjustment between negative and positive tilt conditions.

6. A mechanism according to claim 1, wherein an intermediate link is adapted to couple said support to said linkage, said intermediate link is supported by said third pivot connection selectively for pivotal movement between positions of negative and positive tilt, and manual clamping means carried by said first pivot connection releasably constrains said intermediate link against said pivotal movement.

7. A mechanism according to claim 1, wherein said first locking surface is carried by said lower link.

8. A mechanism according to claim 7, wherein said linkage is essentially a parallelogram linkage.

9. A mechanism according to claim 7, wherein a coil spring is carried by said second pivot connection and has opposite ends arranged to engage said upper link and said mounting member to partially counterbalance the weight of said linkage and said support.

10. A mechanism according to claim 7, wherein said first locking surface is curved, and said second locking surface is generally planar.

11. A mechanism according to claim 10, wherein said first locking surface lies essentially equidistant from said fourth pivot connection.

12. A mechanism according to claim 7, wherein said first locking surface lies essentially equidistant from said fourth pivot connection and said second locking surface is generally planar.

13. A mechanism according to claim 12, wherein the radius of curvature of said first locking surface is selected for positioning said support in a horizontal attitude in said lower and upper positions and positions therebetween.

14. A mechanism according to claim 12, wherein the radius of curvature of said first locking surface is selected for providing said support with a positive tilt in said lower and upper positions and positions therebetween.

15. A mechanism according to claim 12, wherein the radius of curvature of said first locking surface is selected for providing said support with a negative tilt in said lower and upper positions and positions therebetween.

16. A mechanism according to claim 7, wherein said first locking surface is shaped to provide said support with an essentially horizontal attitude in said upper position and intermediate positions adjacent thereto and with a negative tilt in said lower position and intermediate positions adjacent thereto.

17. A mechanism according to claim 7, wherein said first and second locking surfaces are serrated and lie along concentric arcs having a common center of curvature defined by said fourth pivot connection.

18. A mechanism according to claim 7, wherein said first locking surface has a relatively large radius of curvature adjacent a first end thereof and a relatively small radius of curvature adjacent a second end thereof, as measured from said fourth pivot connection, said first end of said first locking surface is arranged for engagement with said second locking surface when said support is adjacent said lower position and said second end of said first locking surface is arranged for engagement with said second locking surface when said support is adjacent said upper position.

19. A mechanism according to claim 7, wherein said lower position is defined by engagement of said upper link with said fourth pivot connection and said first locking surface with said second locking surface.

20. A mechanism according to claim 7, wherein said mounting member has a downwardly facing surface defining said second locking surface and the force of gravity tends to swing said linkage downwardly about said second pivot connection to force said first locking surface into locking engagement with said locking second surface.

21. A mounting mechanism for mounting a support for an art device on a base, comprising a mounting member for attachment to said base, a four bar linkage having a first end for mounting said support and a second end pivotally connected to said mounting member for permitting vertical swinging movement of said support relative to said mounting member between lower and upper positions, said linkage including a relatively upper link, a relatively lower link, a first end link, a second end link, and first, second, third and fourth pivot connections having parallel axes, wherein said upper link has opposite ends pivotally coupled to said first end and second end links by said first and second pivot connections and said lower link has opposite ends pivotally coupled to said first end and second end links by said third and fourth pivot connections, and said second end of said linkage is pivotally connected to said mounting member solely by said second pivot connection; and a locking means for releasably retaining said support in positions intermediate said lower and upper positions, said locking means including a first locking surface defined by said linkage and a second downwardly facing locking surface defined by said mounting member, the force of gravity tending to swing said linkage about said second pivot connection to force said first locking surface upwardly into locking engagement with said second locking surface for releasably locking said support against downwardly directioned vertical swinging movement, and said first locking surface is released from engagement with said second locking surface by applying an upwardly directed manual force to said support.

22. A mechanism according to claim 21, wherein said first locking surface is curved and said second locking surface is planar.

23. A mechanism according to claim 21, wherein said linkage is essentially a parallelogram and said first and second locking surfaces cooperate to maintain said support in a horizontal attitude when in said lower and upper positions and in positions therebetween.

24. A mechanism according to claim 21, wherein said linkage is essentially a parallelogram and said first and second locking surfacers cooperate to maintain said support in a positive tilt attitude when in said lower and upper positions and in positions therebetween.

25. A mechanism according to claim 21, wherein said linkage is essentially a parallelogram an said first and second locking surfaces cooperate to maintain said support in a negative tilt attitude when in said lower and upper positions and in positions therebetween.

26. A mechanism according to claim 21, wherein said linkage is a parallelogram and said first and second locking surfaces cooperate to maintain said support in a horizontal attitude in said upper position and positions adjacent said upper position and in a negative tilt attitude in said lower position and positions adjacent said lower position.

27. A mechanism according to claim 21, wherein a coil spring is carried by said pivot connection and has opposite ends arranged to engage said linkage and said mounting member to partially counterbalance the weight of said linkage and said support.

28. A mechanism according to claim 21, wherein an intermediate link is adapted to couple said support to said linkage for adjustment between negative and positive tilt positions.

* * * * *